US005594975A

United States Patent [19]

Christen

[11] Patent Number: 5,594,975

[45] Date of Patent: Jan. 21, 1997

[54] ADJUSTABLE TOOL HANDLE

[75] Inventor: Jack P. Christen, Wesley Chapel, Fla.

[73] Assignee: White Mop Wringer Company, Tampa, Fla.

[21] Appl. No.: 388,192

[22] Filed: Feb. 13, 1995

[51] Int. Cl.[6] ..... A47L 13/52; B25G 1/00; B25G 3/00

[52] U.S. Cl. ..... 16/114 R; 16/DIG. 24; 15/257.7; 294/58; 294/92; D32/74

[58] Field of Search ..... 16/111 R, 114 R, 16/DIG. 24; 294/58, 57, 92; 15/143.1, 144.1, 145, 257.1, 257.7; D32/74

[56] References Cited

U.S. PATENT DOCUMENTS

| | | | |
|---|---|---|---|
| 1,370,194 | 3/1921 | Cunha . | |
| 1,741,810 | 12/1929 | Bidal . | |
| 2,105,349 | 1/1938 | Dawson | 294/92 |
| 2,187,494 | 1/1940 | Gray | 294/92 |
| 2,297,577 | 9/1942 | Monte | 16/111 R |
| 2,617,363 | 11/1952 | Anketell | 16/114 R |
| 3,217,635 | 11/1965 | Scavullo | 16/114 R |
| 3,341,235 | 9/1967 | Mattson et al. | 16/114 R |
| 4,225,104 | 9/1980 | Larson | 16/114 R |
| 4,276,675 | 7/1981 | Pioch | 16/111 R |
| 4,856,546 | 8/1989 | Kummunsalo | 135/20 R |
| 4,986,587 | 1/1991 | Lozano | 15/257.1 |
| 5,352,060 | 10/1994 | Poetker | 16/114 R |
| 5,432,978 | 7/1995 | Menke et al. | 16/114 R |

FOREIGN PATENT DOCUMENTS

| | | |
|---|---|---|
| 71134 | 8/1947 | Norway . |
| 118572 | 9/1918 | United Kingdom . |
| 247668 | 2/1926 | United Kingdom . |

*Primary Examiner*—M. Rachuba
*Assistant Examiner*—Donald M. Gurley
*Attorney, Agent, or Firm*—Fish & Neave; Robert R. Jackson; G. Victor Treyz

[57] ABSTRACT

A handle for a tool such as a lobby dustpan is provided. The handle is preferably mounted on a vertical shaft of the tool. The handle may be placed in either a locked position or an unlocked position. In the locked position the handle is rigidly connected to the shaft. In the unlocked position the handle moves freely with respect to the shaft.

20 Claims, 7 Drawing Sheets

ADJUSTABLE TOOL HANDLE

BACKGROUND OF THE INVENTION

This invention relates to handles for tools such as commercial lobby dustpans, and more particularly to handles that can be positioned where desired axially along and preferably also circumferentially around the shaft of a tool such as a lobby dustpan.

Commercial lobby dustpans having a dirt collection chamber mounted onto the end of a vertical shaft are well known. Such dustpans are used by cleaning personnel to collect refuse in the lobbies of buildings and other heavily trafficked areas. The vertical shaft allows a user to position the cleaning implement without having to stoop or bend as would be the case if a handheld implement such as a household dustpan were used.

Although shaft-mounted cleaning implements are typically provided with standard-length shafts, not all users are of the same height. With push brooms, sponge mops, and similar cleaning implements, the shaft generally assumes an angle relative to the surface to be cleaned that accommodates the user's height. Moreover, much of the work of using the tool is performed by the larger, stronger muscle groups such as those in the shoulders, back, and legs. With tools such as lobby dustpans, however, the shaft is held vertically. In order to manipulate the dustpan, the user must grasp the vertical shaft of the dustpan somewhere along its length and lift it with much greater reliance on smaller, weaker muscle groups such as those in the wrist and elbow. Thus using a conventional lobby dustpan tends to be both awkward and tiring. A design that is more sensitive to ergonomic concerns would therefore be desirable. It is accordingly an object of this invention to provide a handle for a vertically-shafted tool such as a lobby dustpan that facilitates manipulation of the tool by the user. It is a further object of the invention to provide an adjustable handle for a lobby dustpan that accommodates various user heights and operating preferences.

SUMMARY OF THE INVENTION

These and other objects of the invention are accomplished in accordance with the principles of the invention by providing a handle for use with the vertical shaft of a tool such as a lobby dustpan, said handle being movable axially along and preferably also circumferentially around the shaft. The handle preferably contains a cavity with two opposing apertures for receiving the shaft. The cavity is defined by two overlapping bores. A first bore has a diameter about equal to that of the shaft. A second bore has a diameter slightly greater than that of the shaft.

The handle can be placed in either a locked or an unlocked position on the shaft. When the handle is in the locked position, the shaft is forced into the first bore. The first bore frictionally holds the shaft in place. When the handle is in the unlocked position, the shaft is forced into the second bore. Because the second bore is larger than the shaft, when the handle is in the unlocked position, the handle can be moved freely relative to the shaft. To adjust the location of the handle along the length of the shaft or to adjust the angular orientation of the handle about the shaft, the user places the handle in the unlocked position. After locating the handle where desired, the user returns the handle to the locked position.

Further features of the invention, its nature and various advantages will be more apparent from the accompanying drawings and the following detailed description of the preferred embodiments.

DETAILED DESCRIPTION OF THE PREFERRED EMBODIMENTS

Although the invention is also applicable to other types of tools, the invention is particularly useful on commercial lobby dustpans. The invention will therefore be fully understood from the following explanation of its use in the context of such dustpans.

Figure 1:
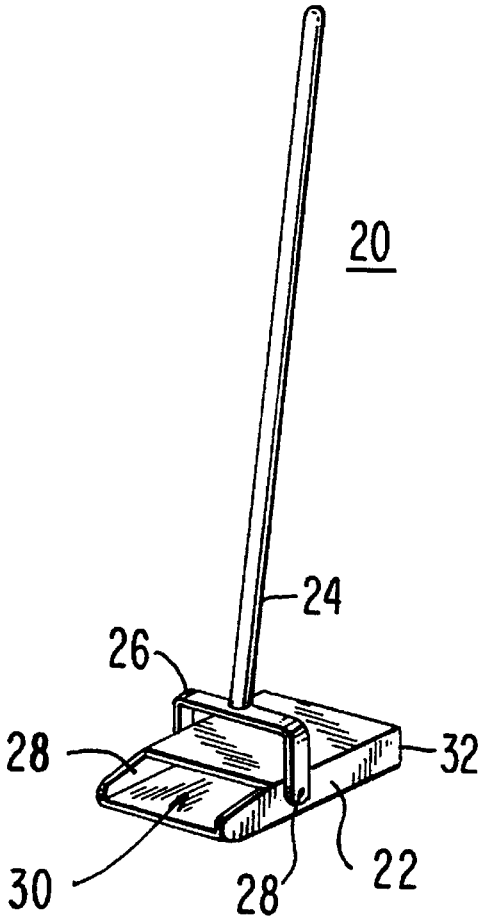
FIG. 1 PRIOR ART
FIG. 1 is a perspective view of a conventional lobby dustpan.

A conventional lobby dustpan is shown in FIG. 1. Dustpan 20 has a dust collection compartment 22 that is connected to shaft 24 via yoke member 26. The yoke member 26 is attached to the dust collection compartment 22 at pivot points 28. The user manipulates the dustpan 20 by grasping the vertical shaft 24.

When the dustpan 20 is raised from the surface being cleaned, the dust collection compartment 22 rotates under its own weight so that the open end 30 of the compartment faces upward. With the open end 30 directed upward, refuse that has been swept into the dust collection compartment 22 falls farther into the compartment, allowing the dustpan 20 to be freely repositioned by the user without loss of the collected refuse. To sweep additional refuse into the dust collection compartment 22, the user lowers the rear end 32 of the dust collection compartment 22 to the surface being cleaned. When the rear end 32 of the compartment touches that cleaning surface, the user can tilt the dust collection compartment 22 forward, lowering the open end 30 of the dust collection compartment 22 until it is level with the surface being cleaned.

Although the user may manipulate the dustpan 20 by grasping the vertical shaft 24 at a point along its length, this can be awkward. For example, when the user wishes to place the open end 30 level with the surface being cleaned, the user must lower the dust collection compartment 22 and simultaneously move it in the forward direction to tilt the dust collection compartment forward. But because the vertical shaft 24 may be axially symmetric, the user will often be uncertain in which direction the dust collection compartment 22 is facing. Further, because the shaft has a fairly small diameter, the user does not have much purchase on the shaft when rotating the dustpan. Typically the user must make extensive prolonged, and repeated use of relatively small muscle groups in the hand, wrist, and elbow to use the conventional dustpan. This can be very tiring to the user.

Figure 2:
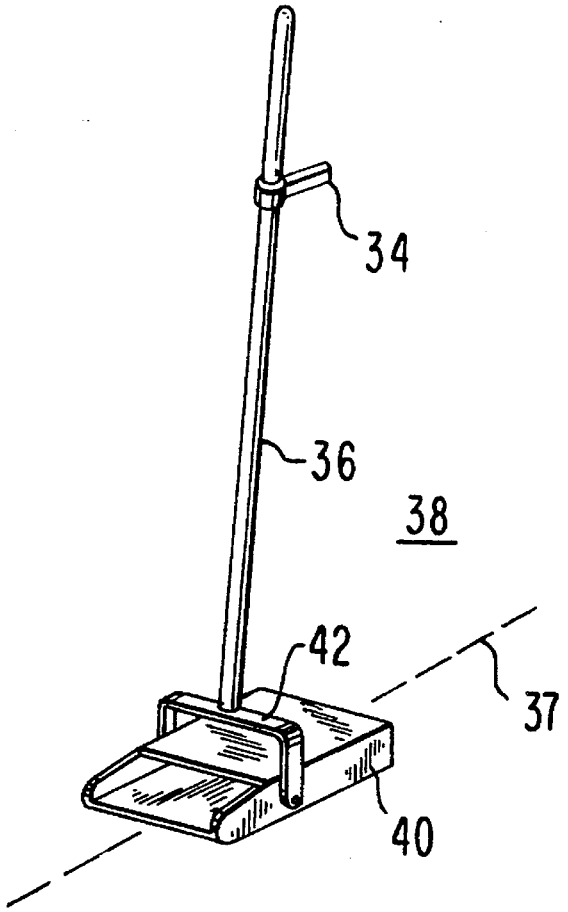
FIG. 2 is a perspective view of a lobby dustpan with an illustrative adjustable handle constructed in accordance with the present invention.

In accordance with the present invention, a handle is provided that can be attached to the vertical shaft of a tool such as a lobby dustpan. An illustrative handle is shown in FIG. 2. Handle 34 is attached to vertical shaft 36 of lobby dustpan 38 and projects radially outward from the shaft. Dustpan 38 preferably has a dust collection compartment 40 to which the shaft 36 is mounted via yoke member 42. One advantage of the handle 34 is that the handle provides feedback as to the rotational orientation of the dustpan about the longitudinal axis of shaft 36. The user therefore immediately knows in which direction to move the dust collection compartment 40 to tip the open end of the dust collection compartment toward the surface being cleaned. Further, because the handle 34 protrudes radially from the vertical shaft 36, the handle helps the user to manipulate the dustpan 38.

Figure 4:
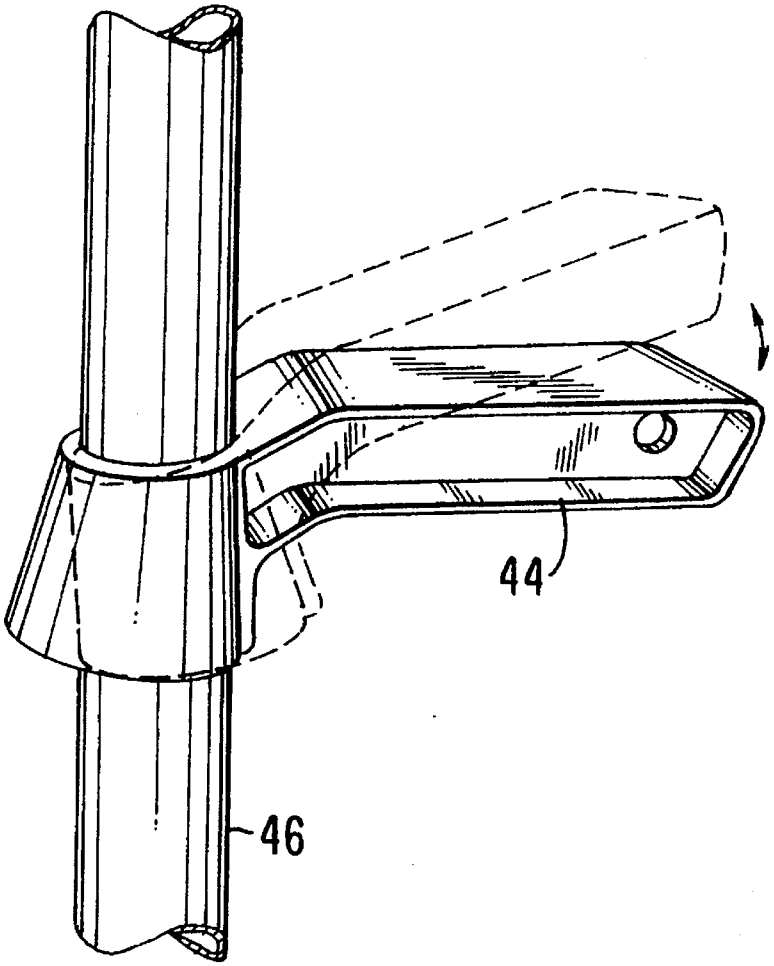
FIG. 4 is a perspective view of the handle of FIG. 3 in the unlocked position.
Figure 3:
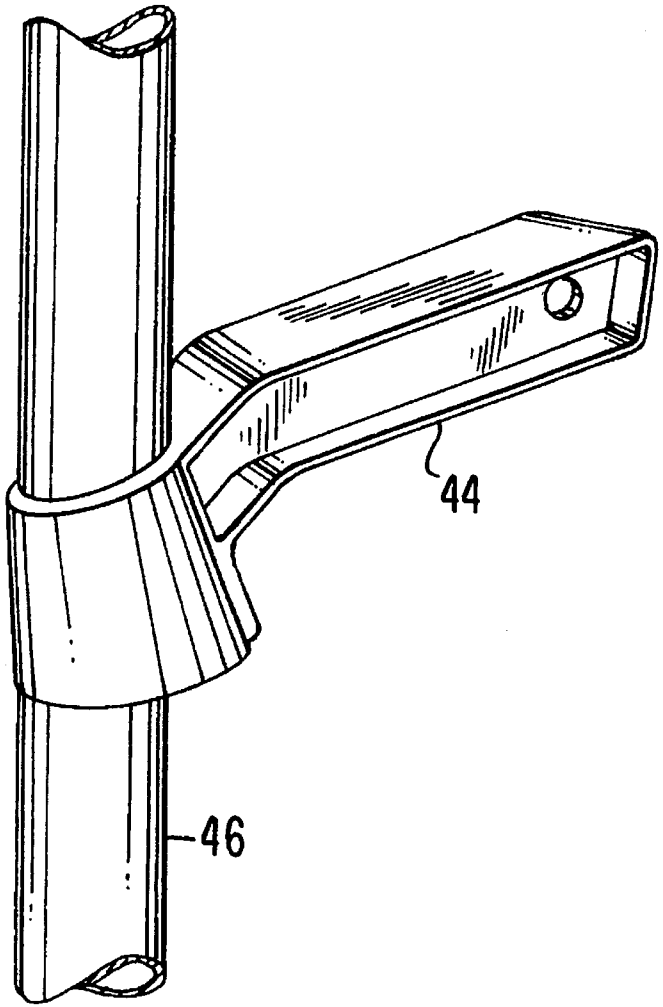
FIG. 3 is a more detailed perspective view of an illustrative adjustable handle constructed in accordance with the present invention. The handle is in the locked position.

The position of the handle 34 along the length of the vertical shaft 36 is preferably adjustable by the user. An illustrative adjustable handle (re-numbered 44) is shown in FIGS. 3 and 4. During normal use, the handle 44 is in the locked position shown in FIG. 3, in which the shaft 46 and the handle 44 are rigidly connected. When it is desired to adjust the vertical placement of the handle 44 along the shaft 46, the handle is rotated downward into the unlocked position of FIG. 4. In the unlocked position the handle 44 can be moved freely along the shaft 46. After the user places the handle 44 where desired along the shaft, the user returns the handle 44 to the locked position of FIG. 3.

In addition to adjusting the vertical position of handle 34/44 relative to the shaft, the user preferably may adjust the angular orientation of the handle about the shaft. One possible configuration is to mount the handle 34 with its longitudinal axis oriented along center axis 37 of dustpan 38 as shown in FIG. 2. Alternatively, the handle can be oriented so that its longitudinal axis is perpendicular relative to the center axis of the dustpan. Some users may prefer orienting the handle so that its longitudinal axis is parallel to center axis 37, but with the handle rotated about the shaft by 180 degrees relative to the position shown in FIG. 2.

The adjustability of the handle position allows users to position the handle according to individual preference. If a user becomes fatigued with the handle in one position, the handle position can be changed. Indeed, even the mode of use of the dustpan can be changed with an appropriate change in the height and/or angular orientation of handle 34. For example, a user may prefer to sweep across the front of his or her body into the dustpan. Or the user may prefer to sweep toward or alongside his or her feet into the dustpan. Whatever the desired mode of use, a suitable height and angle of handle 34 can be found that facilitates that mode of use. Moreover, the presence of handle 34 allows the user to shift much of the work of using the dustpan from the small muscle groups in the hand, wrist, and elbow to the larger muscle groups in the shoulders, back, and legs. Preferably, the user can quickly change the handle between the locked and unlocked positions without the use of tools.

Figure 5:
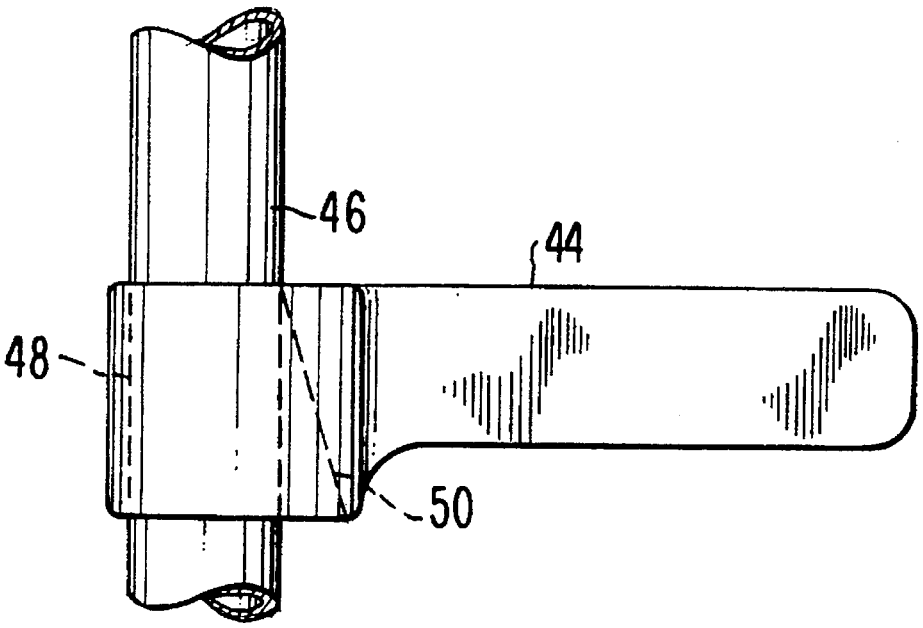
FIG. 5 is a simplified, partly sectional, side view of the handle of FIG. 3 in the locked position.
Figure 6:
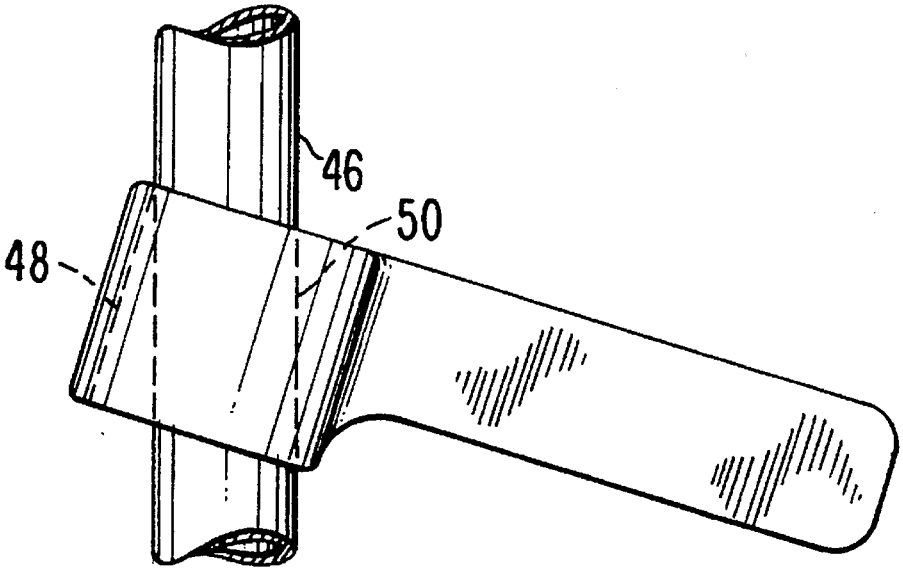
FIG. 6 is a simplified, partly sectional, side view of the handle of FIG. 3 in the unlocked position.

As shown in FIGS. 5 and 6, the handle 44 preferably contains two partly, laterally overlapping cylindrical bores that are axially angled with respect to one another. Bore 48 has a nominal diameter comparable to that of the nominal diameter of the shaft 46, so that there is a nearly zero clearance condition between bore 48 and shaft 46. When the handle 44 is placed in the locked position, shaft 46 is forced into bore 48. Slight out-of-round variations in the diameter of the shaft 46 and handle 44 of approximately 5–10 mils, which arise during the normal course of manufacturing shaft 46 and handle 44, help bore 48 to frictionally lock shaft 46 in place. Bore 50 has a diameter greater than the diameter of the shaft 46. When the handle 44 is placed in the unlocked position, the shaft 46 is shifted into bore 50, where shaft 46 reciprocates and also preferably rotates freely relative to the handle 34.

Because bores 48 and 50 partly laterally overlap, these two bores form a cavity within the handle 44 that preferably has the shape of two partly, laterally overlapping cylinders. Part of the surface of the cavity follows the cylindrically shaped contours of bore 48. The remainder of the surface of the cavity follows the cylindrically shaped contours of bore 50.

Figure 7:
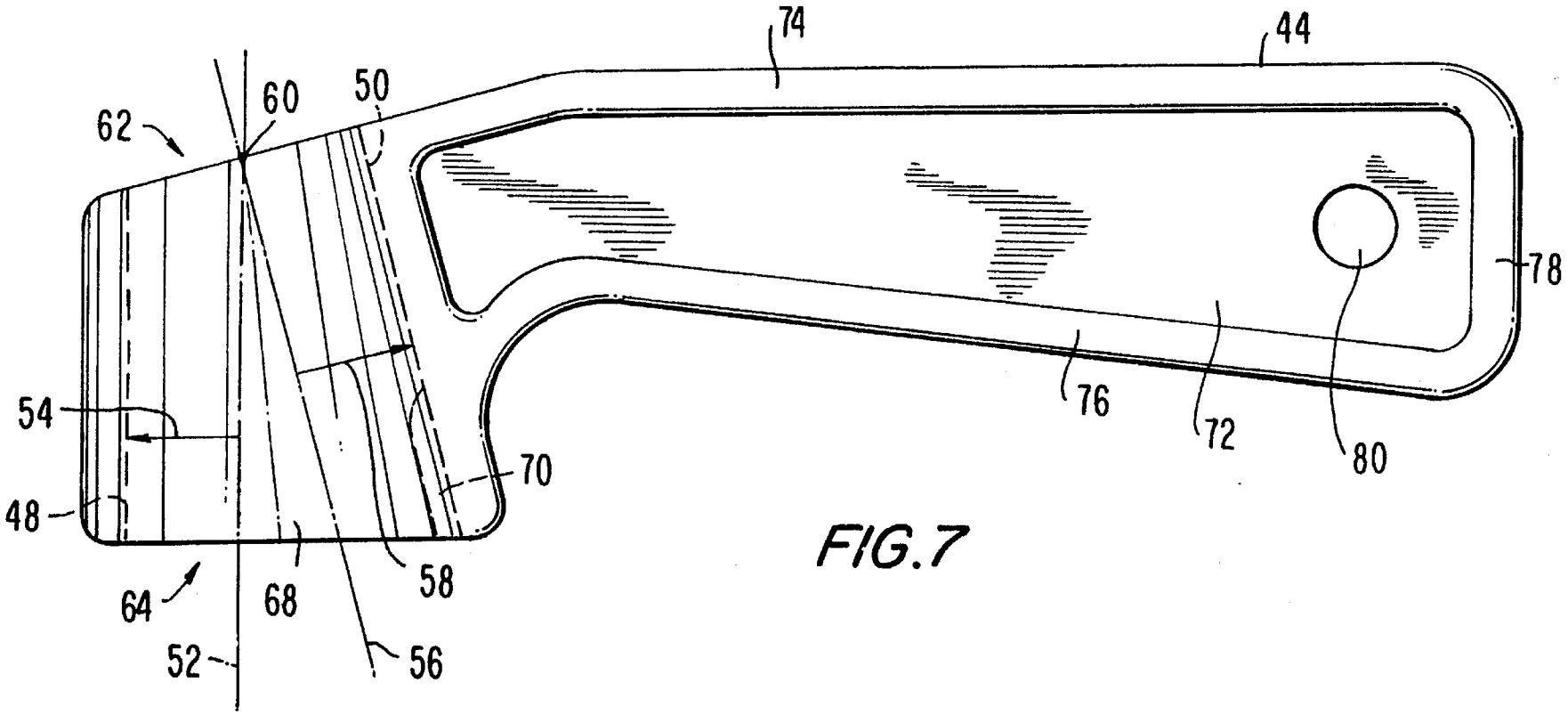
FIG. 7 is a side view of the handle of FIG. 3.
Figure 8:
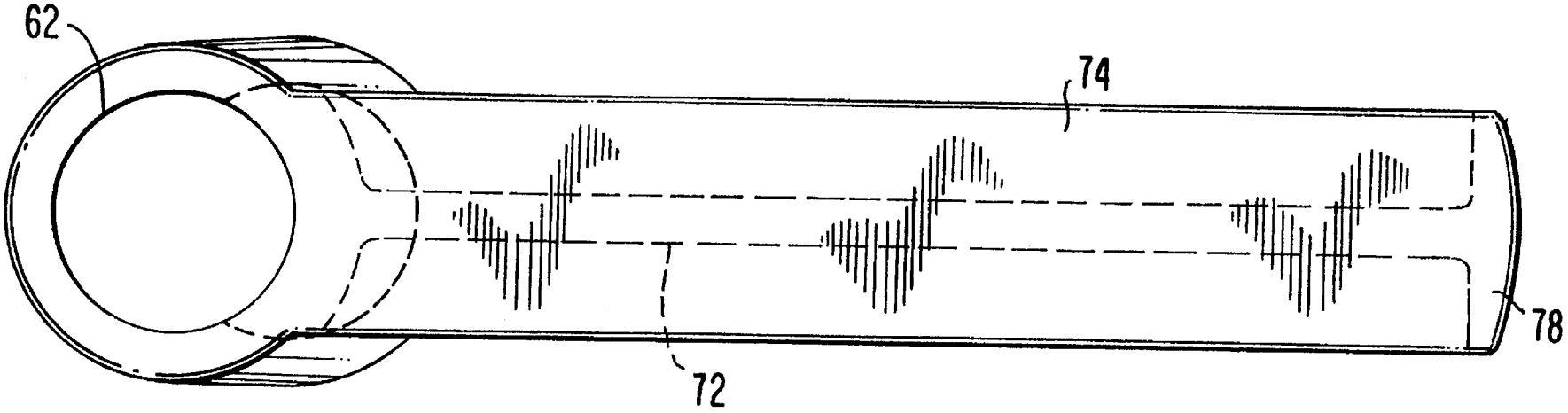
FIG. 8 is a top view of the handle of FIG. 3 taken along the axis of the bore used to lock the handle to the shaft.
Figure 9:
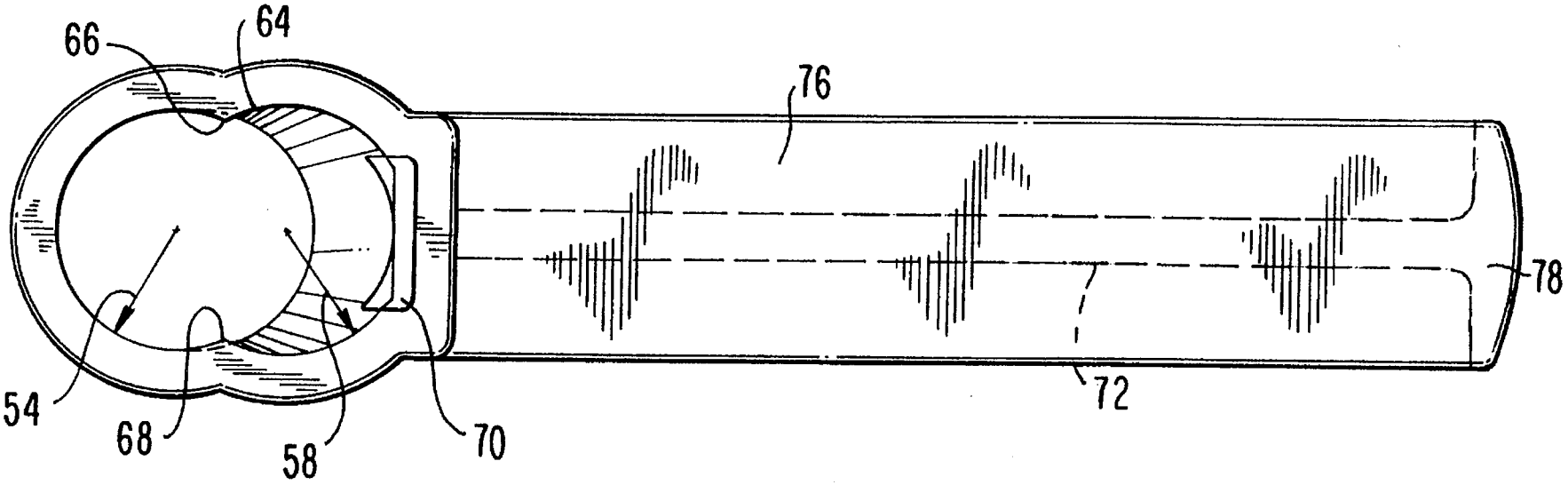
FIG. 9 is a bottom view of the handle of FIG. 3 taken along the axis of the bore used to lock the handle to the shaft.

The cylindrical bores 48 and 50 are shown in greater detail in FIGS. 7–9. Cylindrical bore 48 has central longitudinal axis 52 and radius 54. Cylindrical bore 50 has central longitudinal axis 56 and radius 58. Longitudinal axis 52 and longitudinal axis 56 meet at intersection point 60. The angular separation between axis 52 and axis 56 is preferably about 15°.

Bores 48 and 50 define upper aperture 62 and lower aperture 64 in handle 44. Preferably, upper aperture 62 is roughly circular in shape, with intersection point 60 at its center. Lower aperture 64 resembles two partly overlapping or intersecting circles 66 and 68.

The specific shapes of the upper and lower apertures 62 and 64 depend on the overall shape used for the handle 44, and are not critical. For example, upper aperture 62 need not be circular. If portions of handle 44 were to extend above intersection point 60 in FIG. 7, bores 48 and 50 would extend farther along longitudinal axes 52 and 56 in the upward direction, and the upper aperture 62 formed by bores 48 and 50 would resemble two partly overlapping or intersecting circles. Similarly, the upper aperture would resemble two partly overlapping or intersecting circles if the top surface of the handle 44 were not to extend as far upward as is shown in FIG. 7. Although the upper aperture 62 could resemble two overlapping circles, an arrangement in which upper aperture 62 is roughly circular has the aesthetic advantage that in both the locked and unlocked positions the aperture 62 surrounds the shaft 46 without a significant gap. Such a gap might appear unsightly to the user.

Another factor that affects the shapes of the upper and lower apertures 62 and 64 is the cross-sectional shape of the shaft 46. Preferably, shaft 46 has a circular cross section. Bores 48 and 50 are therefore preferably cylindrical and apertures 62 and 64 are shaped as shown in FIGS. 7–9. If shaft 46 has a different cross section, such as an ellipse or a polygon, then the shapes of apertures 62 and 64, and the corresponding shapes of bores 48 and 50 will be changed accordingly. An advantage of the circular cross section is that the angular position of the shaft can be adjusted. Whatever the cross-sectional shape of the shaft 46, the cross-sectional dimensions of bore 48 are such that shaft 46 is frictionally held in place when placed in bore 48. Similarly, the cross-sectional dimensions of bore 50 are such that the shaft 46 can be moved freely relative to the handle when placed in bore 50.

Regardless of the specific shapes of the upper and lower apertures 62 and 68 and bores 48 and 50, when it is desired to change the handle between the locked and unlocked positions, the user must apply a force sufficient to cause the shaft 46 to slightly deform the walls of bores 48 and 50 so that the shaft 46 can move from one bore to the other.

As shown in FIGS. 7 and 8, when bores 48 and 50 are cylindrical bores, cusp-like ridges 66 and 68 form where the walls of the bores intersect. These ridges 66 and 68 project into the interior of the handle aperture and prevent the shaft 46 from slipping between one bore and the other, unless the user of the apparatus deliberately causes the shaft to shift in this manner. Ridges 66 and 68 therefore cooperate with shaft 46 to provide a detent that must be overcome to shift the shaft from one bore to the other. Note that with ridges 66 and 68 being most pronounced adjacent one end of the cavity in handle 34, the substantially circular other end of the cavity provides a fulcrum against shaft 46 which facilitates pivoting the handle relative to the shaft in order to force a diameter of the shaft through the distance between ridges 66 and 68 when the user desires to shift the shaft from alignment with one bore to alignment with the other bore. The distance between ridges 66 and 68 is normally less than the diameter of shaft 46, but this dimensional relationship yields briefly when shifting shaft 46 from one bore to the other bore. If the bores 48 and 50 have an elliptical or polygonal cross section, protrusions comparable to cusp-like ridges 66 and 68 are formed (or can be added) to provide the same locking mechanism provided by ridges 66 and 68.

Figure 10:
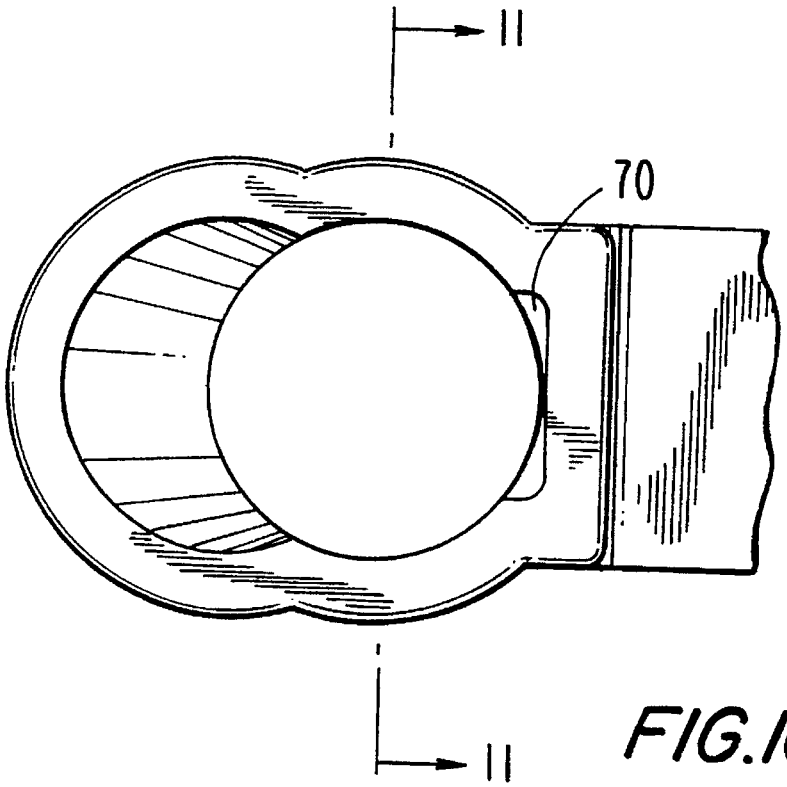
FIG. 10 is a bottom view of a portion of the handle of FIG. 3 taken along the axis of the bore in which the shaft reciprocates freely.
Figure 11:
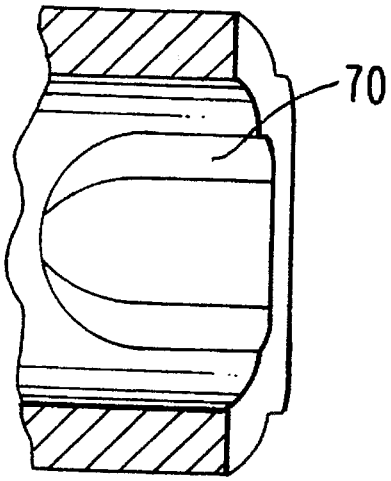
FIG. 11 is a cross sectional view of a portion of the handle of FIG. 3 taken along the line 11—11 in FIG. 10.

The handle 44 is preferably formed of a molded plastic such as a medium-impact polystyrene and the shaft is formed from plastic tubing such as extruded polyvinyl chloride (PVC) tubing. The materials used to form the shaft 46 and handle 44 and the relative diameters of the shaft 46 and the bores 48 and 50 allow the handle 44 to be placed in either the locked or unlocked position without undue effort, although some deliberately applied force is required to overcome the above-mentioned detent. Preferably, when the handle 44 is in the locked position the handle 44 is securely fastened to the shaft. If handle 44 is made of a molded plastic and shaft 46 is formed from plastic tubing of about 1.0 inch in diameter, bore 48 preferably has a diameter of about 1.0 inch in diameter and bore 50 preferably has a diameter of about 1,026 inches in diameter. If the handle 44 is made of a molded plastic, handle 44 preferably also has a relief 70, as shown in FIGS. 7 and 9. Relief 70 is shown in more detail in FIGS. 10 and 11 and facilitates molding the handle as one piece.

As shown in FIGS. 7–9, handle 44 preferably has a relatively flat central member 72, which supports upper handle portion 74, lower handle portion 76, and rear handle portion 78. The central member 72 and upper, lower, and rear portions 74, 76, and 78 are all of relatively the same thickness, which facilitates the plastic molding process. The handle 44 preferably has a hole 80 in central member 72 so that the dustpan 38 may be stored on a hook when not in use.

It will be understood that the foregoing is merely illustrative of the principles of this invention, and that various modifications can be made by those skilled in the art without departing from the scope and spirit of the invention.

The invention claimed is:

1. A handle for a cleaning implement having a shaft with a longitudinal axis, comprising:

an elongated handle body having portions at one end forming a cavity with first and second surface openings for receiving said shaft, said cavity being defined by first and second overlapping bores with respective first and second longitudinal axes which are inclined toward one another, said first bore defining a first cavity surface and said second bore defining a second cavity surface, said handle being movable between:

a locked position in which said longitudinal axis of said shaft is aligned with said first longitudinal axis and said first cavity surface frictionally holds said handle in place relative to said shaft; and an unlocked position in which said longitudinal axis of said shaft is aligned with said second longitudinal axis and said second cavity surface is spaced from said shaft so that said handle moves freely relative to said shaft.

2. The handle defined in claim 1 wherein said shaft is cylindrical and said first and second bores are cylindrical.

3. The handle defined in claim 2 wherein:

said shaft has a shaft diameter and said first bore has a first diameter approximately equal to said shaft diameter; and said second bore has a second diameter that is greater than said shaft diameter.

4. The handle defined in claim 1 wherein said first surface opening is roughly a circle.

5. The handle defined in claim 1 wherein said second surface opening resembles two overlapping circles.

6. The handle defined in claim 1 wherein said first longitudinal axes is disposed at an angle of about 15° with respect to said second longitudinal axis.

7. The handle defined in claim 1 wherein said handle is formed of molded plastic.

8. The handle defined in claim 1 wherein said cleaning implement is a lobby dustpan.

9. The handle defined in claim 1 wherein said shaft is a vertical shaft.

10. The handle defined in claim 1 wherein said elongated handle body portion has a longitudinal axis that is substantially perpendicular to said longitudinal axis of said shaft when said handle is in said locked position.

11. An adjustable handle for a lobby dustpan having a vertical cylindrical shaft with a longitudinal axis, comprising:

an elongated handle body having portions at one end forming a cavity with first and second surface openings for receiving said shaft, said cavity being defined by first and second overlapping cylindrical bores with respective first and second longitudinal axes which are inclined toward one another, said first bore defining a first cylindrical cavity surface and said second bore defining a second cylindrical cavity surface, said handle being movable between:

a locked position in which said longitudinal axis of said shaft is aligned with said first longitudinal axis and said first cylindrical cavity surface frictionally holds said handle in place relative to said shaft; and an unlocked position in which said longitudinal axis of said shaft is aligned with said second longitudinal axis and said second cylindrical cavity surface is spaced from said shaft so that said handle moves freely relative to said shaft.

12. The handle defined in claim 11 wherein:

said shaft has a shaft diameter and said first bore has a first diameter approximately equal to said shaft diameter; and said second bore has a second diameter that is greater than said shaft diameter.

13. The handle defined in claim 11 wherein said first surface opening is roughly a circle.

14. The handle defined in claim 11 wherein said second surface opening resembles two overlapping circles.

15. The handle defined in claim 11 wherein said first longitudinal axes is disposed at an angle of about 15° with respect to said second longitudinal axis.

16. The handle defined in claim 11 wherein said handle is formed of molded plastic.

17. The handle defined in claim 11 wherein said elongated body portion has a longitudinal axis substantially perpendicular to said longitudinal axis of said shaft when said handle is in said locked position.

18. An adjustable handle for a tool which has a substantially cylindrical shaft, said shaft having a predetermined shaft diameter, said handle comprising:

a body member having a longitudinal axis and an aperture through said body member substantially perpendicular to said longitudinal axis, the inner surface of said aperture being defined by first and second cylindrical bores which are inclined toward one another and which partly overlap one another so that surfaces of said first and second bores intersect one another at a pair of surface regions which are on respective opposite sides of said aperture, said first bore having a diameter approximately equal to said shaft diameter, said second bore having a diameter which is greater than said shaft diameter, and the distance across said aperture between portions of said surface regions being less than said shaft diameter but large enough to permit a user of said tool to shift said shaft, which is disposed in said aperture, from one of said bores to the other of said bores by forcing a diameter of said shaft to pass between said portions of said surface regions, said handle securely gripping said shaft when said shaft is in said first bore, and said handle being freely movable along and about said shaft when said handle is in said second bore.

19. The apparatus defined in claim 18 wherein said portions of said surface regions are disposed adjacent an end of said aperture where said bores diverge from one another, and wherein said bores converge toward one another adjacent the other end of said aperture so that said inner surface of said aperture adjacent said other end of said aperture acts as a fulcrum against said shaft during pivoting of said handle relative to said shaft in a plane defined by a longitudinal axis of said shaft and said longitudinal axis of said body member to facilitate passage of a diameter of said shaft between said portions of said surface regions.

20. An adjustable handle for a tool which has a substantially cylindrical shaft, said shaft having a predetermined shaft diameter, said handle comprising:

a body member having an aperture through which said shaft can pass, the inner surface of said aperture being defined by first and second substantially cylindrical bores which are partly laterally overlapping, the diameter of said first bore being approximately equal to said shaft diameter, the diameter of said second bore being greater than said shaft diameter, and a portion of said inner surface defining a detent structure which projects inwardly into the interior of said aperture intermediate said first and second bores to releasably retain said shaft in the bore in which said shaft is currently disposed but which retention can be overcome by the user of the tool when the user desires to shift said shaft from one of said bores to the other of said bores, said handle securely gripping said shaft when said shaft is disposed in said first bore, and said handle being freely movable along and about said shaft when said shaft is disposed in said second bore.

* * * * *